US012364304B2

(12) United States Patent
Park

(10) Patent No.: US 12,364,304 B2
(45) Date of Patent: Jul. 22, 2025

(54) ROTATING MEANS FOR HELMET

(71) Applicant: HJC CORP., Gyeonggi-do (KR)

(72) Inventor: Gyeong Jun Park, Gyeonggi-do (KR)

(73) Assignee: HJC CORP., Gyeonggi-do (KR)

( * ) Notice: Subject to any disclaimer, the term of this patent is extended or adjusted under 35 U.S.C. 154(b) by 59 days.

(21) Appl. No.: 18/548,038

(22) PCT Filed: Jan. 5, 2022

(86) PCT No.: PCT/KR2022/000110
§ 371 (c)(1),
(2) Date: Aug. 25, 2023

(87) PCT Pub. No.: WO2022/186465
PCT Pub. Date: Sep. 9, 2022

(65) Prior Publication Data

US 2024/0130460 A1 Apr. 25, 2024
US 2024/0225167 A9 Jul. 11, 2024

(30) Foreign Application Priority Data

Mar. 4, 2021 (KR) ..... 10-2021-0028518

(51) Int. Cl.
*A42B 3/22* (2006.01)

(52) U.S. Cl.
CPC ..... *A42B 3/223* (2013.01)

(58) Field of Classification Search
CPC ..... A42B 3/223; A42B 3/222; A42B 3/225
See application file for complete search history.

(56) References Cited

U.S. PATENT DOCUMENTS

| | | | | |
|---|---|---|---|---|
| 4,748,696 | A | 6/1988 | Fohl | |
| 6,047,409 | A | 4/2000 | Simpson | |
| 6,622,314 | B1 * | 9/2003 | Kim | A42B 3/222 2/424 |
| 7,181,777 | B2 * | 2/2007 | Choi | A42B 3/222 2/424 |
| 8,745,763 | B2 * | 6/2014 | Cho | A42B 3/223 2/424 |
| 11,678,710 | B2 * | 6/2023 | Whitesell | A42B 3/222 2/15 |
| 12,029,271 | B2 * | 7/2024 | Isobe | A42B 3/222 |
| 2006/0117467 | A1 * | 6/2006 | Choi | A42B 3/222 2/424 |

(Continued)

FOREIGN PATENT DOCUMENTS

| | | | |
|---|---|---|---|
| CN | 104963926 | 10/2015 | |
| EP | 2762022 A1 * | 8/2014 | A42B 3/222 |

(Continued)

*Primary Examiner* — Khaled Annis
(74) *Attorney, Agent, or Firm* — DUANE MORRIS LLP; Gregory M. Lefkowitz

(57) ABSTRACT

The present disclosure relates to a rotating means for a helmet, and the rotating means for the helmet according to the present invention comprises a rotary shaft (100) which allows a shield (30) to be rotatably coupled to a helmet body (10) so that an opening portion (20) of the helmet body (10) is opened/closed by the shield (30), and when the shield (30) is rotated in the direction of closing the opening portion (20), the rotary shaft (100) is moved to the rear direction with respect to the helmet body (10).

15 Claims, 8 Drawing Sheets

(56) References Cited

U.S. PATENT DOCUMENTS

| | | | | |
|---|---|---|---|---|
| 2009/0183302 | A1* | 7/2009 | Choi | A42B 3/222 2/424 |
| 2011/0094019 | A1* | 4/2011 | Isobe | A42B 3/222 2/424 |
| 2012/0117718 | A1* | 5/2012 | Cho | A42B 3/223 2/424 |
| 2013/0081199 | A1* | 4/2013 | Nimura | A42B 3/221 2/421 |
| 2014/0352020 | A1* | 12/2014 | Isobe | A42B 3/223 2/9 |
| 2020/0229529 | A1* | 7/2020 | Hunt | A42B 3/223 |
| 2022/0346488 | A1* | 11/2022 | Whitesell | A42B 3/222 |
| 2024/0130460 | A1* | 4/2024 | Park | A42B 3/222 |

FOREIGN PATENT DOCUMENTS

| | | | | |
|---|---|---|---|---|
| JP | S63227804 | | 9/1988 | |
| KR | 200344909 | | 3/2004 | |
| KR | 1020110012043 | | 2/2011 | |
| KR | 1020140001141 | | 1/2014 | |
| KR | 1020140081791 | | 7/2014 | |
| KR | 101465079 | | 11/2014 | |
| WO | WO-2022186465 | A1 * | 9/2022 | A42B 3/222 |

* cited by examiner

ROTATING MEANS FOR HELMET

CROSS-REFERENCE TO RELATED APPLICATIONS

This application is a § 371 national stage entry of International Application No. PCT/KR2022/000110, filed on Jan. 5, 2022, which claims priority to Korean Patent Application No. 10-2021-0028518, filed on Mar. 4, 2021, the entire contents of which are incorporated herein by reference.

TECHNICAL FIELD

The present disclosure relates to a rotating means for a helmet.

BACKGROUND ART

In general, it is mandatory to wear a helmet while driving a two wheeled vehicle with high speed to protect the wearer's head. The helmet has a front open portion to ensure the wearer's frontal field of view. Additionally, the helmet may include a shield that can selectively open and close the open portion to keep out wind, dust, etc. while driving.

Meanwhile, as disclosed by the following related literature, the motorcycle helmet has the shield that rotates arounds a fixed rotation axis. Accordingly, since the shield of the motorcycle helmet according to the prior art can only make a simple circular motion, it is impossible to form a tight seal between the shield and the edge of the open portion, and a gasket at the edge of the open portion may be damaged by rubbing of the shield against the gasket during the shield's circular motion.

RELATED LITERATURES

Patent Literature (Patent Literature 1) KR10-2014-0001141 A

DISCLOSURE

Technical Problem

The present disclosure is designed to solve the above-described problem, and an aspect of the present disclosure relates to a rotating means for a helmet in which a shield is disposed at the relatively front side of the helmet body immediately until it closes the open portion, and when the shield rotates in a direction of closing the open portion, a rotation axis of the shield moves rearward with respect to the helmet body, thereby forming a tight seal between the shield and the edge of the open portion.

Technical Solution

A rotating means for a helmet according to an embodiment of the present disclosure includes a rotation axis which rotatably couples a shield to a helmet body to allow the shield to open and close an open portion of the helmet body, wherein the rotation axis moves rearward with respect to the helmet body in response to rotation of the shield in a direction of closing the open portion.

Additionally, the rotating means for the helmet according to an embodiment of the present disclosure may further include a movement means to couple the rotation axis to the helmet body to allow the rotation axis to move forward and rearward with respect to the helmet body.

Additionally, the rotating means for the helmet according to an embodiment of the present disclosure may further include an elastic means to provide the movement means with an elastic force in a rearward direction of the helmet body.

Additionally, in the rotating means for the helmet according to an embodiment of the present disclosure, the rotation axis may move forward with respect to the helmet body in response to the rotation of the shield in a direction of opening the open portion.

Additionally, in the rotating means for the helmet according to an embodiment of the present disclosure, the rotation axis may move rearward with respect to the helmet body in response to the rotation of the shield at a first predetermined angle in a direction of opening the closed open portion, and the rotation axis may move rearward with respect to the helmet body in response to the rotation of the shield at a second predetermined angle smaller than the first predetermined angle in the direction of opening the closed open portion.

Additionally, in the rotating means for the helmet according to an embodiment of the present disclosure, the movement means may include a first guide to guide the rotation of the shield and the movement of the rotation axis, and the shield may include a second guide that comes into contact with the first guide by the elastic force of the elastic means.

Additionally, in the rotating means for the helmet according to an embodiment of the present disclosure, the first guide may include a contact surface extended in an arc shape, and the second guide may move in contact with the contact surface.

Additionally, in the rotating means for the helmet according to an embodiment of the present disclosure, a first recessed portion may be formed at one end of the contact surface, a second recessed portion may be formed at the other end of the contact surface, a protruding portion may be formed between the first recessed portion and the second recessed portion on the contact surface, the rotation axis may move rearward with respect to the helmet body in response to the contact of the second guide with the first recessed portion and the second recessed portion, and the rotation axis may move forward with respect to the helmet body in response to the contact of the second guide with the protruding portion.

Additionally, in the rotating means for the helmet according to an embodiment of the present disclosure, the second guide may be secured by the elastic force of the elastic means in response to the contact of the second guide with the first recessed portion and the second recessed portion.

Additionally, in the rotating means for the helmet according to an embodiment of the present disclosure, an auxiliary recessed portion may be formed in the middle of the protruding portion on the contact surface, and the rotation axis may move rearward with respect to the helmet body in response to the contact of the second guide with the auxiliary recessed portion.

Additionally, in the rotating means for the helmet according to an embodiment of the present disclosure, the second guide may be secured by the elastic force of the elastic means in response to the contact of the second guide with the auxiliary recessed portion.

Additionally, in the rotating means for the helmet according to an embodiment of the present disclosure, the movement means may include a moving body at which the rotation axis is disposed, and a support body coupled to the helmet body to support the moving body to move forward and rearward with respect to the helmet body.

Additionally, the rotating means for the helmet according to an embodiment of the present disclosure may further include an elastic means disposed between the moving body and the support body to provide the moving body with an elastic force in a rearward direction of the helmet body.

Additionally, in the rotating means for the helmet according to an embodiment of the present disclosure, any one of the moving body and the support body may have a slide protrusion which protrudes toward the other, and the other one of the moving body and the support body may have a slide groove extended to allow the slide protrusion inserted therein to slide.

Additionally, in the rotating means for the helmet according to an embodiment of the present disclosure, the rotation axis may be a bolt which is inserted into the shield and the movement means.

Additionally, in the rotating means for the helmet according to an embodiment of the present disclosure, the bolt may include a manipulation portion formed around a head of the bolt and disposed to rotate with respect to the head around a pivot axis perpendicular to a lengthwise direction of the bolt.

Additionally, in the rotating means for the helmet according to an embodiment of the present disclosure, the bolt may be coupled to the movement means, a first washer may be disposed between a head of the bolt and the shield, any one of the first washer and the movement means may have a coupling protrusion, and the other one of the first washer and the movement means may have a coupling groove into which the coupling protrusion is inserted.

Additionally, in the rotating means for the helmet according to an embodiment of the present disclosure, a second washer may be disposed between the shield and the first washer, and the second washer may be a lubricating member.

The features and advantages of the present disclosure will be apparent from the following detailed description in accordance with the accompanying drawings.

Prior to the description, it should be understood that the terms or words used in the specification and the appended claims should not be construed as limited to general and dictionary meanings, but rather interpreted based on the meanings and concepts corresponding to the technical spirit of the present disclosure on the basis of the principle that the inventor is allowed to define terms appropriately for the best explanation.

Advantageous Effects

According to the present disclosure, the shield is disposed at the relatively front side of the helmet body immediately until it closes the open portion, and when the shield rotates in a direction of closing the open portion, the rotation axis of the shield moves rearward with respect to the helmet body, thereby forming a tight seal between the shield and the edge of the open portion.

Additionally, according to the present disclosure, the shield is disposed at the relatively front side of the helmet body immediately until it closes the open portion, and when the shield rotates in a direction of closing the open portion, the rotation axis of the shield moves rearward with respect to the helmet body, thereby preventing damage to the gasket at the edge of the open portion caused by rubbing of the shield against the gasket.

BEST MODE

The objectives, particular advantages and new features of the present disclosure will be apparent from the following detailed description and exemplary embodiments in association with the accompanying drawings. In affixing the reference numbers to the elements of each drawing in the present disclosure, it should be noted that identical elements are given as identical numbers as possible although they are depicted in different drawings. Additionally, the terms such as "first", "second", "one end", "the other end" or the like are used to distinguish one element from another, and the elements are not limited by the terms. Hereinafter, in describing the present disclosure, when it is determined that a certain description of related known technology may unnecessarily obscure the subject matter of the present disclosure, the detailed description is omitted.

Hereinafter, exemplary embodiments of the present disclosure will be described in detail with reference to the accompanying drawings.

Figure 1:
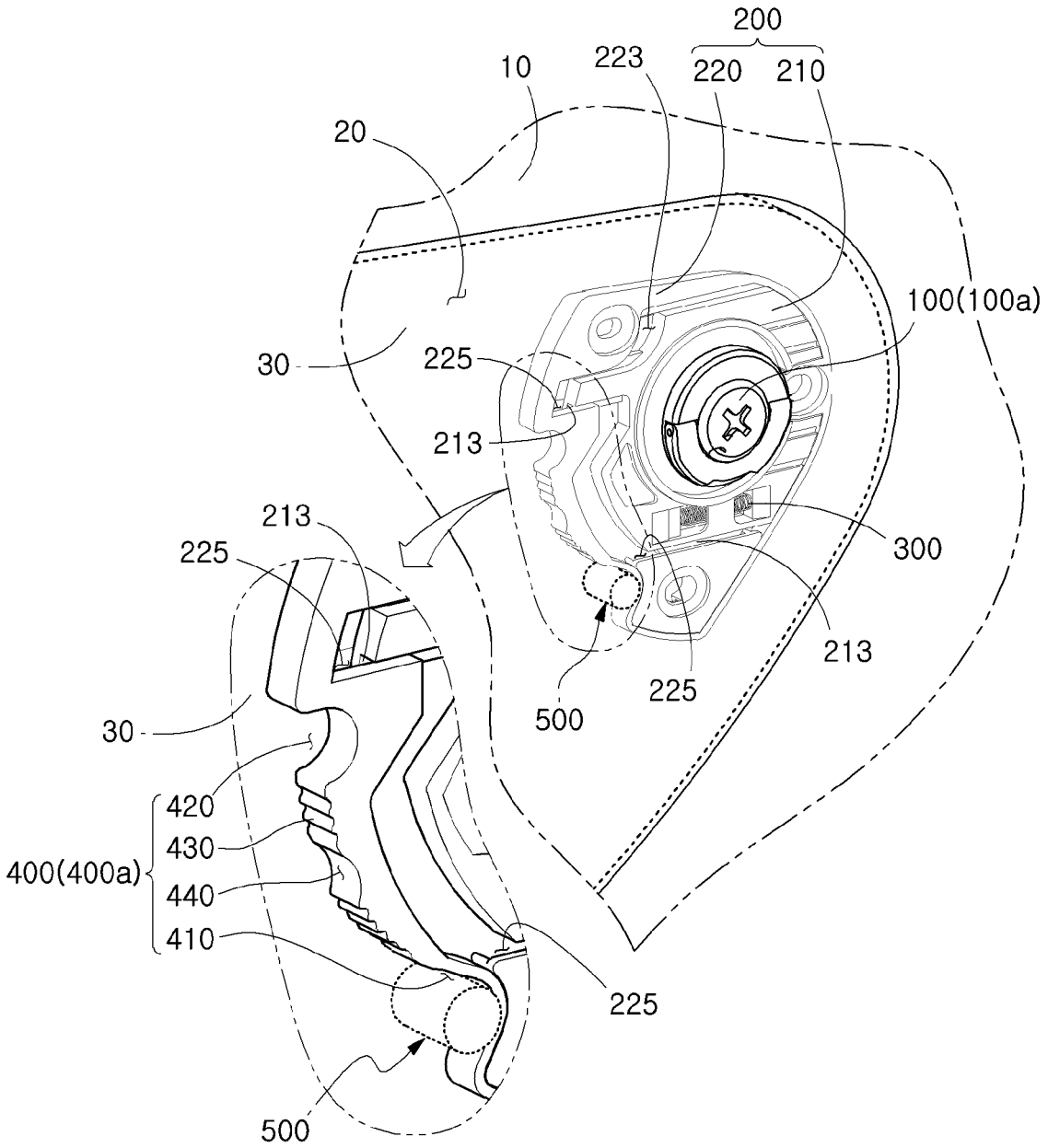
FIG. 1 is a perspective view of a rotating means for a helmet according to an embodiment of the present disclosure.
Figure 2:
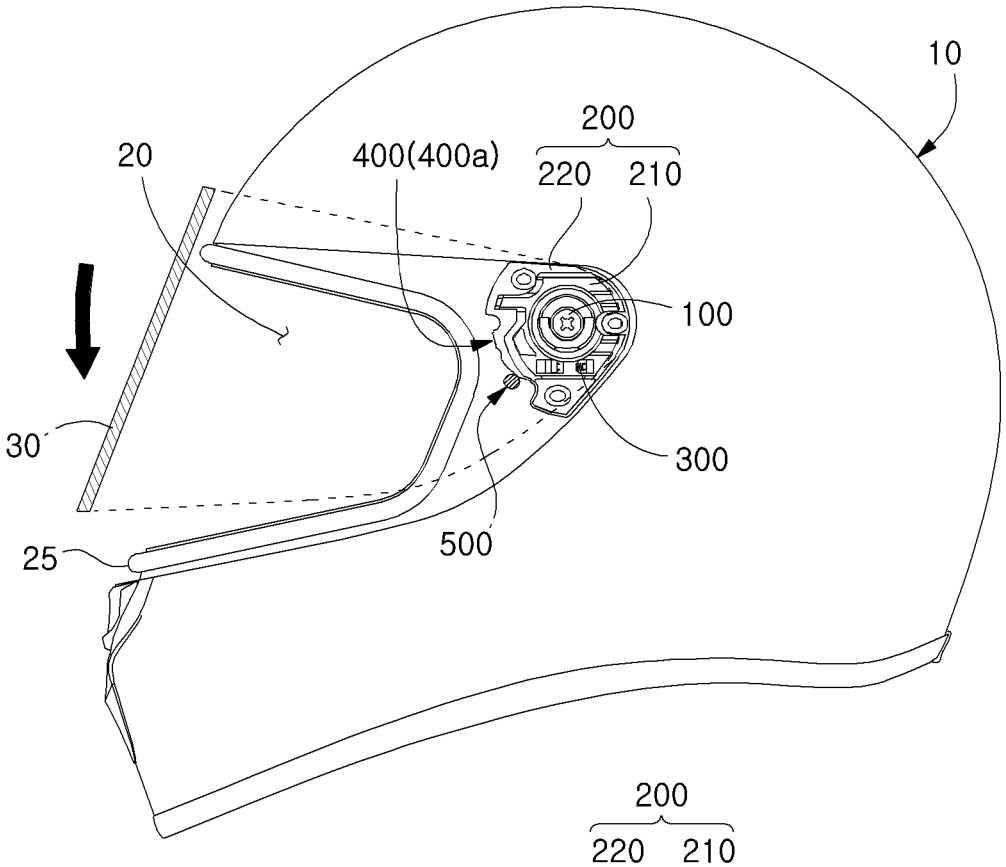
FIGS. 2 to 7 are side views showing an operation process of a rotating means for a helmet according to an embodiment of the present disclosure.
Figure 2:
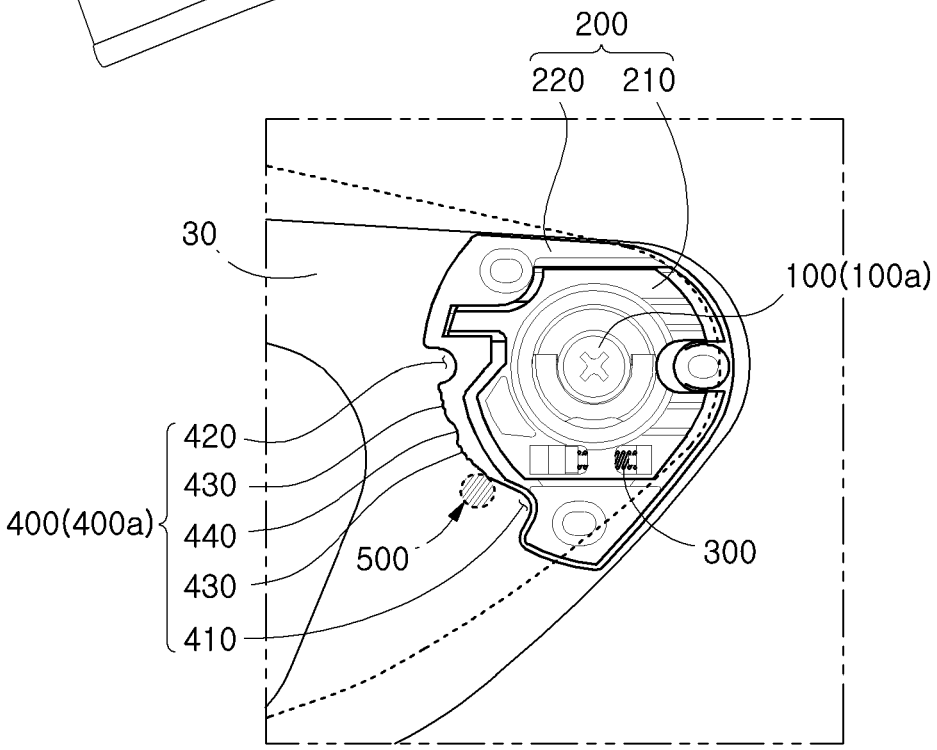
Figure 3:
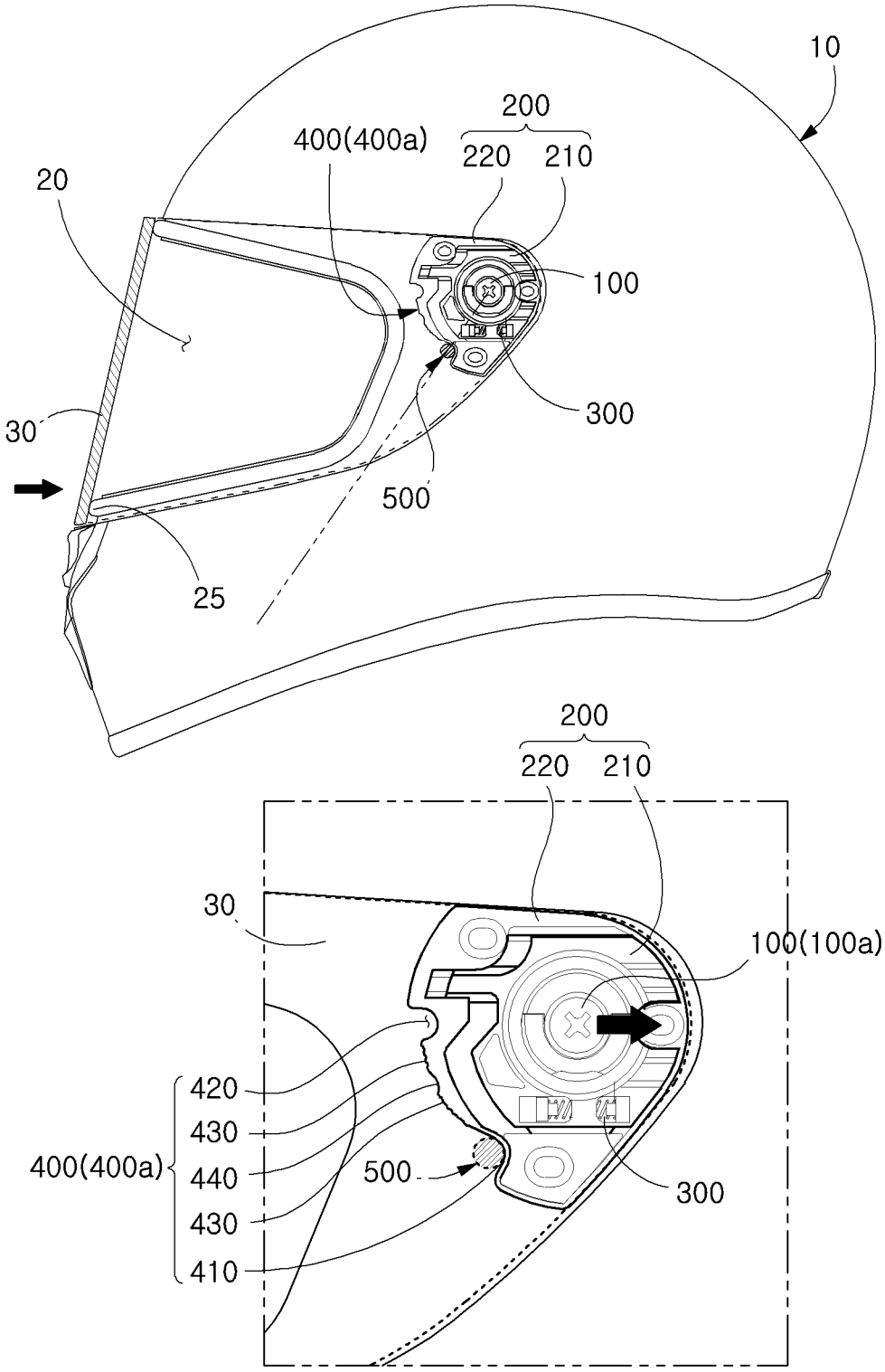

FIG. 1 is a perspective view of a rotating means for a helmet according to an embodiment of the present disclosure, and FIGS. 2 and 3 are side views showing an operation process of the rotating means for the helmet according to an embodiment of the present disclosure.

As shown in FIGS. 1 to 3, the rotating means for the helmet according to an embodiment of the present disclosure includes a rotation axis 100 to rotatably couple a shield 30 to a helmet body 10 to allow the shield 30 to open and close an open portion of the helmet body 10, and the shield 30 is disposed at the relatively front side of the helmet body 10 immediately until it closes the open portion 20, and when the shield 30 rotates in a direction of closing the open portion 20, the rotation axis 100 moves rearward with respect to the helmet body 10.

Basically, the helmet body 10 plays a role in protecting a user's head. The helmet body 10 may be made of a shock absorbing material. For example, the helmet body 10 may include an outer shell of hard synthetic resin and having high strength, and an absorber disposed in the outer shell, made of an expanded polystyrene (EPS) foam and having proper strength and elasticity. A pad may be present inside the absorber to improve a snug fit.

Additionally, the shield 30 plays a role in opening and closing the open portion formed at the front side of the helmet body 10, and is rotatably coupled to two sides of the helmet body 10 by the rotation axis 100 to rotate with respect to the helmet body and is rotatable from a first location to a second location. For example, the first location may refer to a location at which the shield 30 closes the open portion 20 (see FIG. 3), and the second location may refer to a location at which the shield 30 opens the open portion 20 (see FIG. 7). The shield 30 is rotated by the rotating means for the helmet according to this embodiment, and hereinafter, the rotating means for the helmet will be described in more detail.

The rotating means for the helmet according to this embodiment includes the rotation axis 100. Here, the rotation axis 100 rotatably couples the shield 30 to the helmet body 10 to allow the shield 30 to open and close the open portion 20 of the helmet body 10. In this instance, the rotation axis 100 may move forward and rearward with respect to the helmet body 10. Accordingly, the shield 30 may make not only a circular motion around the rotation axis 100 but also a translational motion with the forward and rearward movement of the rotation axis 100. Through this configuration, as shown in FIGS. 2 and 3, when the shield 30 rotates (rotates downward) in the direction of closing the open portion 20, the rotation axis 100 may move to the rear side of the helmet body 10. As described above, when the shield 30 closes the open portion 20, the rotation axis 100 moves to the rear side of the helmet body 10, and the shield 30 also moves to the rear side of the helmet body 10, and thus a tight seal may be formed between the shield 30 and the edge of the open portion 20. Additionally, the shield 30 is disposed at the relatively front side of the helmet body 10 immediately until it closes the open portion 20, and the shield 30 moves to the rear side of the helmet body 10 and comes into contact with a gasket 25 formed at the edge of the open portion 20 while it completely closes the open portion 20. Accordingly, when the shield 30 rotates, the shield 30 is spaced apart from the gasket 25 of the open portion 20, and finally, when the shield 30 completely closes the open portion 20, the shield 30 comes into contact with the gasket 25 of the open portion. Ultimately, it may be possible to prevent damage to the gasket 25 of the open portion 20 caused by rubbing of the shield 30 against the gasket 25 while the shield 30 closes the open portion 20.

Figure 4:
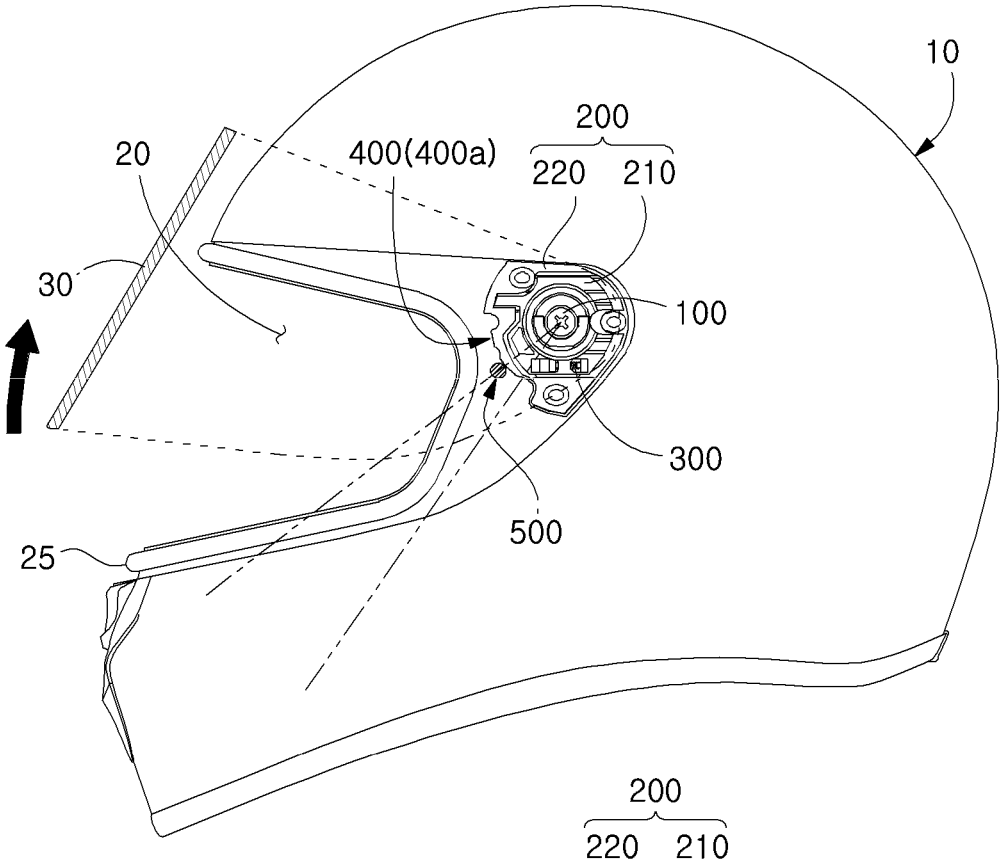
Figure 4:
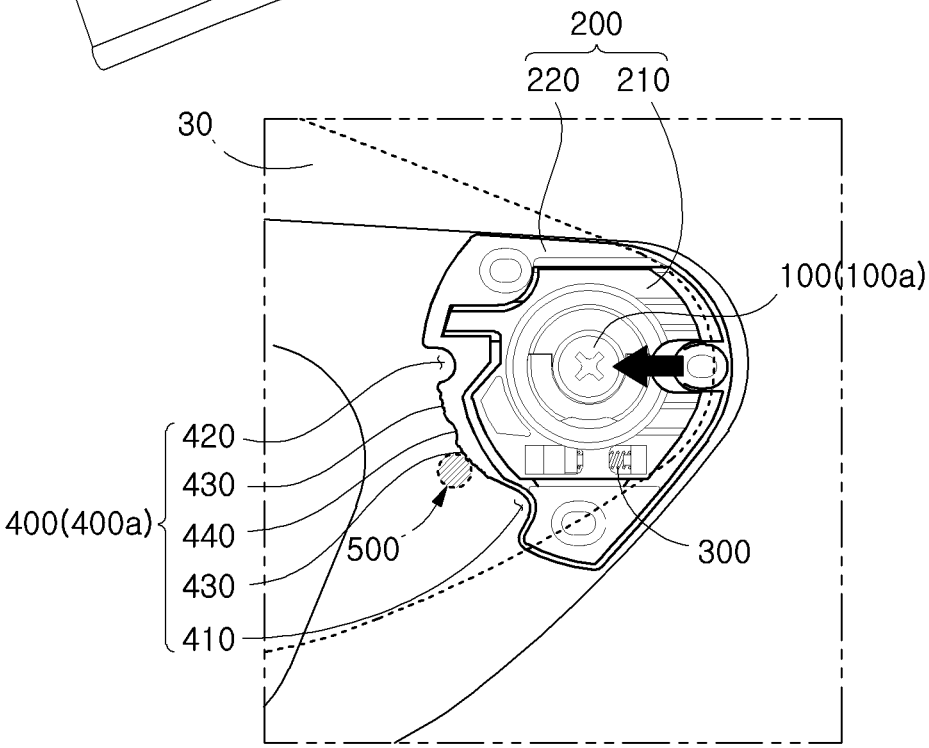

Additionally, as shown in FIG. 4, when the shield 30 rotates (rotates upward) in a direction of opening the closed open portion 20, the rotation axis 100 moves to the front side of the helmet body 10. As described above, since the shield 30 moves to the front side of the helmet body 10 while it opens the open portion 20, the shield 30 is spaced apart from the gasket 25 of the open portion 20 during rotation. Ultimately, it may be possible to prevent damage to the gasket 25 of the open portion 20 caused by rubbing of the shield 30 against the gasket 25 while the shield 30 opens the open portion 20.

Figure 5:
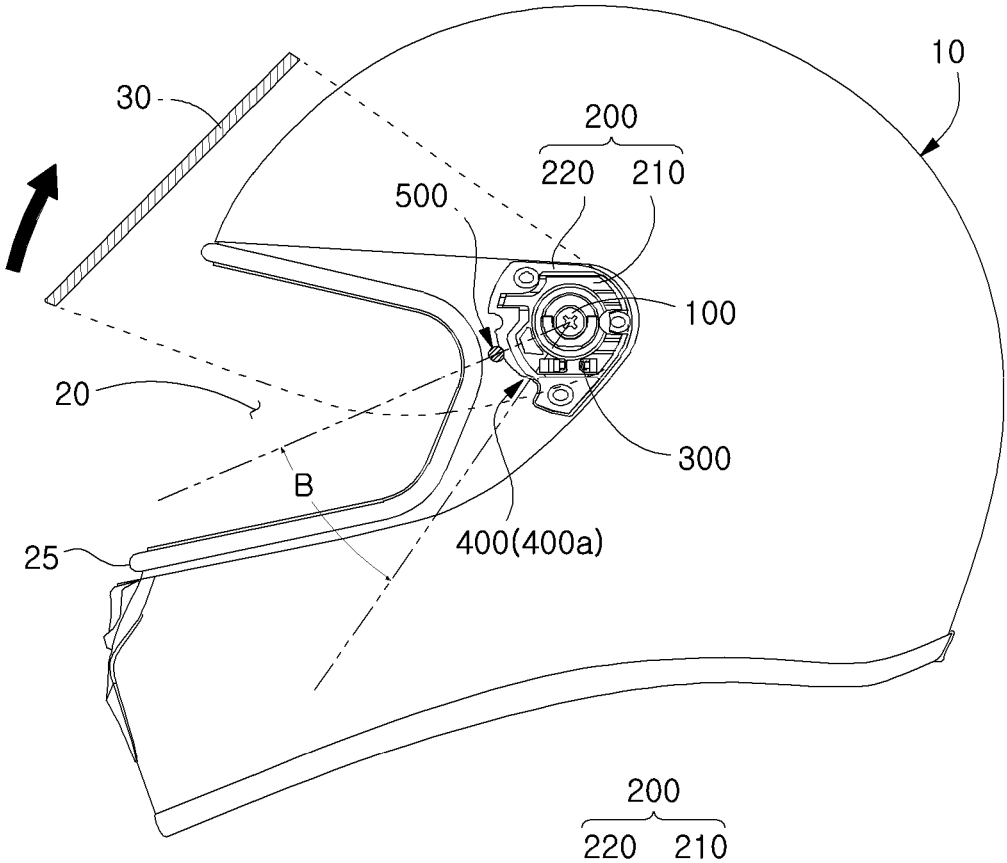
Figure 5:
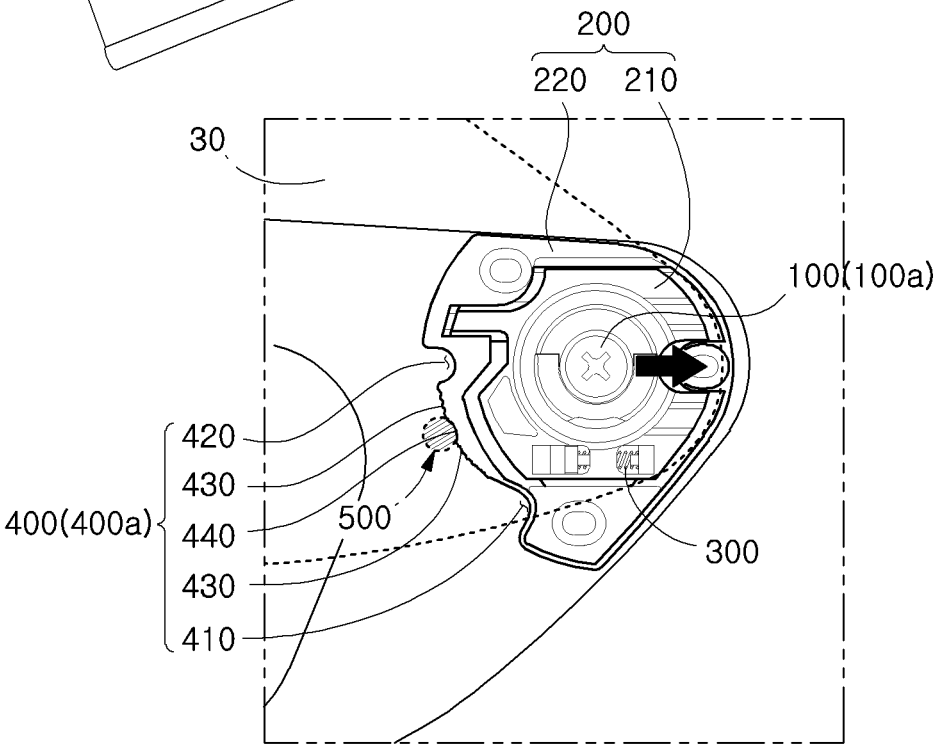
Figure 7:
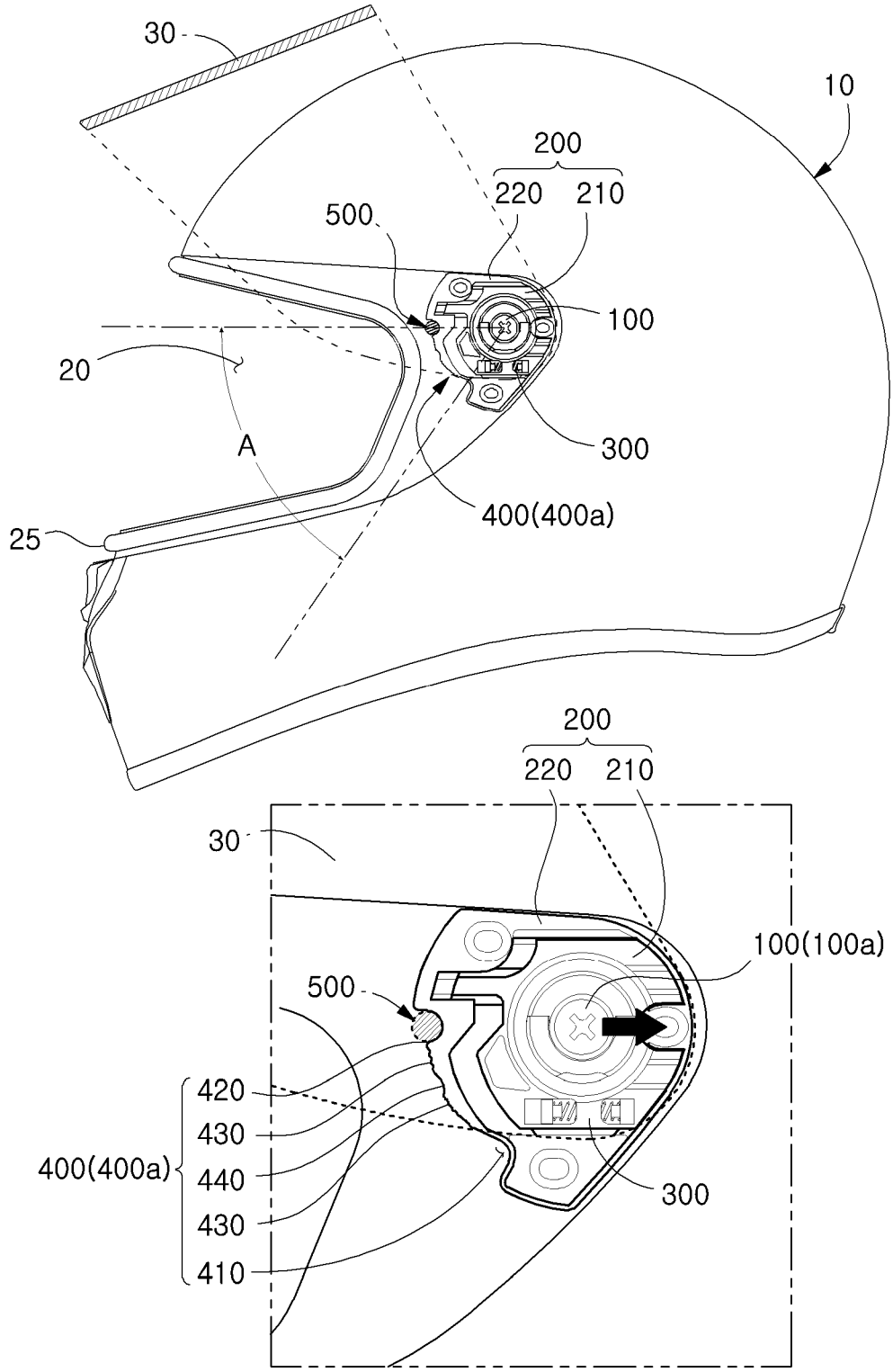

Additionally, as shown in FIG. 7, when the shield 30 rotates at a first predetermined angle A in the direction of opening the closed open portion 20, the rotation axis 100 may move rearward with respect to the helmet body 10 compared to immediately before the rotation at the first predetermined angle A, and as shown in FIG. 5, when the shield 30 rotates at a second predetermined angle B that is smaller than the first predetermined angle A in the direction of opening the closed open portion 20, the rotation axis 100 may move rearward with respect to the helmet body 10 compared to immediately before the rotation at the second predetermined angle B. The movement of the rotation axis 100 is made by the components for securing the shield 30 at a specific angle, and it will be described in detail below.

As shown in FIG. 1, the rotating means for the helmet according to this embodiment may further include a movement means 200 and an elastic means 300.

Here, the movement means 200 couples the rotation axis 100 to the helmet body 10 to allow the rotation axis 100 to move forward and rearward with respect to the helmet body 10. In this instance, the movement means 200 may include a moving body 210 and a support body 220. The moving body 210 may be a place where the rotation axis 100 is disposed and the support body 220 may be coupled to the helmet body 10 to support the moving body 210 to move to the front side and rear side of the helmet body 10. Here, the support body 220 may be formed in an internal predefined space 223, and the moving body 210 may be disposed in the predefined space 223 of the support body 220 and may be supported to move forward and rearward. More specifically, the moving body 210 may have a slide protrusion 213 that protrudes toward the support body 220, and the support body 220 may have a mating slide groove 225 extended to allow the slide protrusion 213 inserted therein to slide. Accordingly, as the slide protrusion 213 slides along the slide groove 225, the moving body 210 may move forward and rearward. In this instance, the slide groove 225 may be formed in the inner wall defining the predefined space 223 of the support body 220. Meanwhile, the present disclosure is not necessarily limited to the moving body 210 having the slide protrusion 213 and the support body 220 having the slide groove 225, and the moving body 210 may have the slide groove 225 and the support body 220 may have the slide protrusion 213.

Additionally, the elastic means 300 provides the movement means 200 with an elastic force in the rearward direction of the helmet body 10. Specifically, the elastic means 300 is disposed between the moving body 210 and the support body 220 to provide the moving body 210 with the elastic force in the rearward direction of the helmet body 10. For example, the elastic means 300 is disposed between a side of the moving body 210 and a side of the support body 220 facing each other to provide the elastic force in a direction of keeping the said side of the moving body 210 and the said side of the support body 220 apart from each other. In this instance, the elastic means 300 is not limited to a particular type, but may be a compression spring.

Additionally, a first guide 400 and a second guide 500 may be included to guide the rotation of the shield 30 and the forward and rearward movement of the rotation axis 100. Specifically, the movement means 200 may include the first guide 400, and the shield 30 may include the second guide 500. In this instance, the first guide 400 may be formed along the outer circumferential surface of the support body 220, and the second guide 500 may be formed in the shape of a protrusion that protrudes from the inner surface of the shield 30. Here, since the shield 30 is secured to the moving body 210 by the rotation axis 100, when the elastic force of the elastic means 300 is provided to the moving body 210, the elastic force of the elastic means 300 is also provided to the shield 30 (in the rearward direction of the helmet body 10). Accordingly, the second guide 500 of the shield 30 may always contact the first guide 400 disposed at the relatively rear side by the elastic force of the elastic means 300. More specifically, the first guide 400 includes a contact surface 400*a* (the outer circumferential surface of the support body 220) extended in an arc shape, and the second guide 500 moves in contact with the contact surface 400*a*. Here, a first recessed portion 410 is formed at one end (a lower end) of the contact surface 400*a*, a second recessed portion 420 is formed at the other end (an upper end) of the contact surface 400*a*, and a protruding portion 430 is formed between the first recessed portion 410 and the second recessed portion 420 on the contact surface 400*a*. Accordingly, when the second guide 500 comes into contact with the first recessed portion 410 and the second recessed portion 420 that are relatively recessed, the shield 30 having the second guide 500 may move rearward by the elastic force of the elastic means 300, and eventually the rotation axis 100 at which the shield 30 is fixed may move rearward with respect to the helmet body 10. In contrast, when the second guide 500 comes into contact with the protruding portion 430 that is relatively protruded, the shield 30 having the second guide 500 may move in the forward direction opposite the direction in which the elastic force of the elastic means 300 acts, and eventually the rotation axis 100 at which the shield 30 is fixed may move forward with respect to the helmet body 10. As described above, when the second guide 500 comes into contact with the first recessed portion 410 and the second recessed portion 420 that are relatively recessed, the elastic force of the elastic means 300 transmitted through the moving body 210→the rotation axis 100→the shield 30 acts on the second guide 500, and the second guide 500 may be inserted and secured to the first recessed portion 410 and the second recessed portion 420 by the elastic force of the elastic means 300. However, when an external force beyond the elastic force of the elastic means 300 acts by a user's manipulation, at the same time as the rotation of the shield 30, the rotation axis 100 and the shield 30 move forward with respect to the helmet body 10, and the second guide 500 may be separated from the first recessed portion 410 and the second recessed portion 420. Meanwhile, when the second guide 500 is secured to the first recessed portion 410, it may be a location at which the shield 30 closes the open portion 20 (first location, see FIG. 3), and when the second guide 500 is secured to the second recessed portion 420, it may be a location at which the shield 30 opens the open portion 20 (second location, see FIG. 7).

As shown in FIG. 1, an auxiliary recessed portion 440 is formed in the middle of the protruding portion 430 on the contact surface 400*a*. Accordingly, when the second guide 500 comes into contact with the auxiliary recessed portion 440 that is relatively recessed, the shield 30 having the second guide 500 may move rearward by the elastic force of the elastic means 300, and eventually, the rotation axis 100 at which the shield is fixed may move rearward with respect to the helmet body 10. As described above, when the second guide 500 comes into contact with the auxiliary recessed portion 440 that is relatively recessed, the elastic force of the elastic means 300 transmitted through the moving body 210→the rotation axis 100→the shield 30 acts on the second guide 500, and the second guide 500 may be inserted and secured to the auxiliary recessed portion 440 by the elastic force of the elastic means 300. Meanwhile, when the second guide 500 is secured to the auxiliary recessed portion 440, it may be a location at which the shield 30 partially opens the open portion 20 (see FIG. 5).

Additionally, a toothed serration may be formed in the protruding portion 430 on the contact surface 400*a*. As the second guide 500 slides along the serration, the shield 30 may rotate, and a clicking sensation may be provided to the user who manipulates the shield 30.

Mode for Invention

FIGS. 2 to 7 are side views showing the operation process of the rotating means for the helmet according to an embodiment of the present disclosure, and the operation process of the rotating means for the helmet according to an embodiment of the present disclosure will be described with reference to FIGS. 2 to 7.

As shown in FIGS. 2 and 3, when the shield 30 rotates (rotates downward) in the direction of closing the open portion 20 from immediately before closing the open portion 20, the second guide 500 of the shield 30 moves in a direction from the protruding portion 430 of the contact surface 400*a* to the first recessed portion 410. In this instance, the elastic force of the elastic means 300 is provided to the second guide 500 through the moving body 210→the rotation axis 100→the shield 30, and the second guide 500 of the shield 30 moves rearward and is inserted into the first recessed portion 410 that is relatively recessed (see the arrow in FIG. 3). At the same time, the moving body 210 moves rearward with respect to the support body 220 by the elastic force of the elastic means 300, and the rotation axis 100 and the shield 30 disposed at the moving body 210 also move rearward. As described above, since the shield 30 moves rearward together with the rotation axis 100 when the shield 30 closes the open portion 20, it may be possible to form a tight seal between the shield 30 and the edge of the open portion 20, and prevent damage to the gasket 25 of the open portion 20 caused by rubbing of the shield 30 against the gasket 25.

As shown in FIGS. 3 and 4, when the shield 30 rotates (rotates upward) in the direction of opening the closed open portion 20, the second guide 500 of the shield 30 moves in a direction from the first recessed portion 410 of the contact surface 400*a* to the protruding portion 430. In this instance, the second guide 500 of the shield 30 moves forward and comes into contact with the protruding portion 430 that is relatively protruded (see the arrow in FIG. 4). At the same time, the moving body 210 moves forward with respect to the support body 220 by overcoming the elastic force of the elastic means 300, and the rotation axis 100 and the shield 30 disposed at the moving body 210 also move forward. As described above, since the shield 30 moves forward together with the rotation axis 100 when the shield 30 opens the open portion 20, it may be possible to prevent damage to the gasket 25 of the open portion 20 caused by rubbing of the shield 30 against the gasket 25.

As shown in FIGS. 4 and 5, when the shield 30 additionally rotates (rotates upward) in the direction of opening the open portion 20, the second guide 500 of the shield 30 moves in a direction from the protruding portion 430 of the contact surface 400*a* to the auxiliary recessed portion 440. In this instance, the elastic force of the elastic means 300 is provided to the second guide 500 in the rearward direction through the moving body 210→the rotation axis 100→the shield 30, and the second guide 500 of the shield 30 moves rearward and is inserted into the auxiliary recessed portion 440 that is relatively recessed (see the arrow in FIG. 5). At the same time, the moving body 210 moves rearward with respect to the support body 220 by the elastic force of the elastic means 300, and the rotation axis 100 and the shield 30 disposed at the moving body 210 also move rearward.

Figure 6:
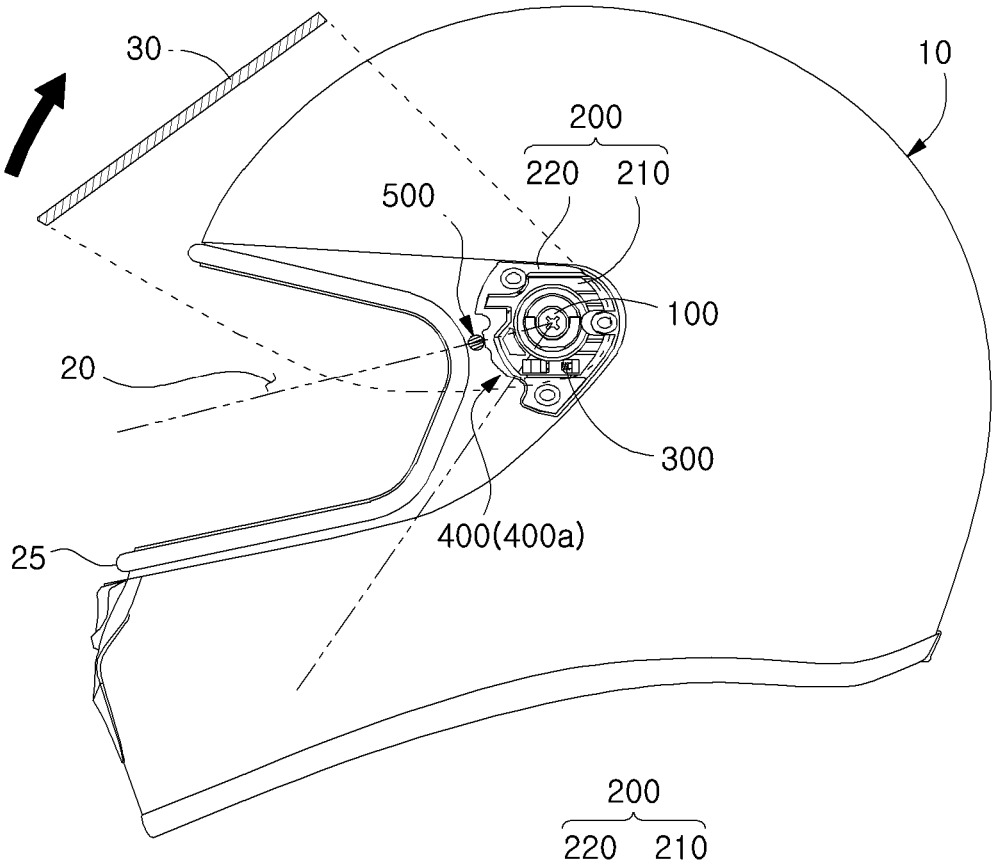
Figure 6:
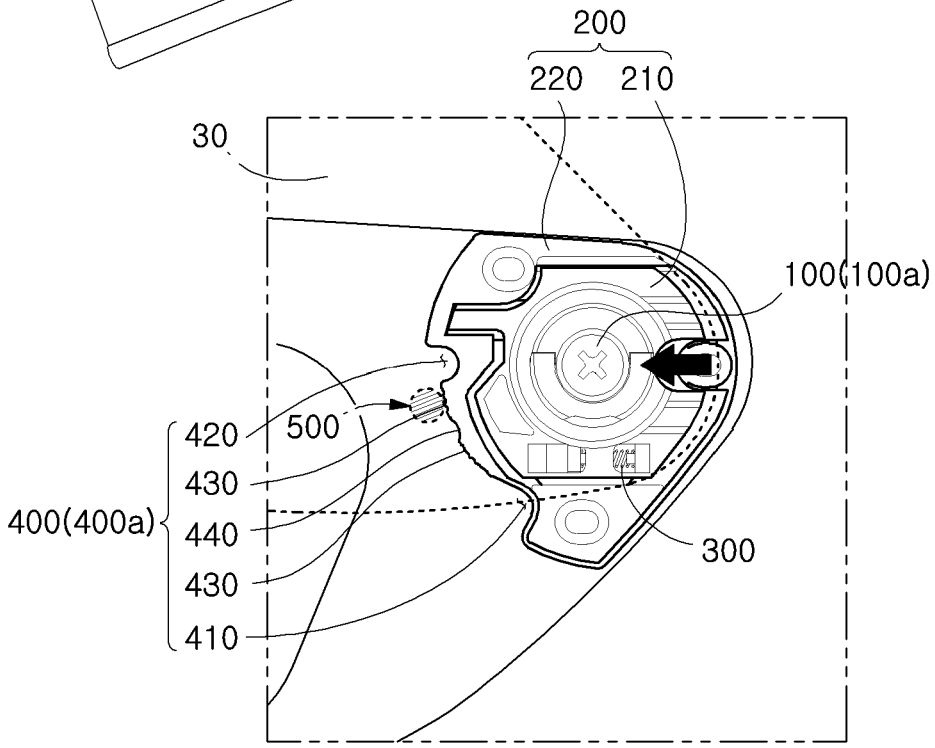

As shown in FIGS. 5 and 6, when the shield 30 additionally rotates (rotates upward) in the direction of opening the open portion 20, the second guide 500 of the shield 30 moves in a direction from the auxiliary recessed portion 440 of the contact surface 400*a* to the protruding portion 430. In this instance, the second guide 500 of the shield 30 moves forward and comes into contact with the protruding portion 430 that is relatively protruded (see the arrow in FIG. 6). At the same time, the moving body 210 moves forward with respect to the support body 220 by overcoming the elastic force of the elastic means 300, and the rotation axis 100 and the shield 30 disposed at the moving body 210 also move forward.

As shown in FIGS. 6 and 7, when the shield 30 additionally rotates (rotates upward) in the direction of opening the open portion 20, the second guide 500 of the shield 30 moves in a direction from the protruding portion 430 of the contact surface 400*a* to the second recessed portion 420. In this instance, the elastic force of the elastic means 300 is provided to the second guide 500 in the rearward direction through the moving body 210→the rotation axis 100→the shield 30, and the second guide 500 of the shield 30 moves rearward and is inserted into the second recessed portion 420 that is relatively recessed (see the arrow in FIG. 7). At the same time, the moving body 210 moves rearward with respect to the support body 220 by the elastic force of the elastic means 300, and the rotation axis 100 and the shield 30 disposed at the moving body 210 also move rearward.

Figure 8:
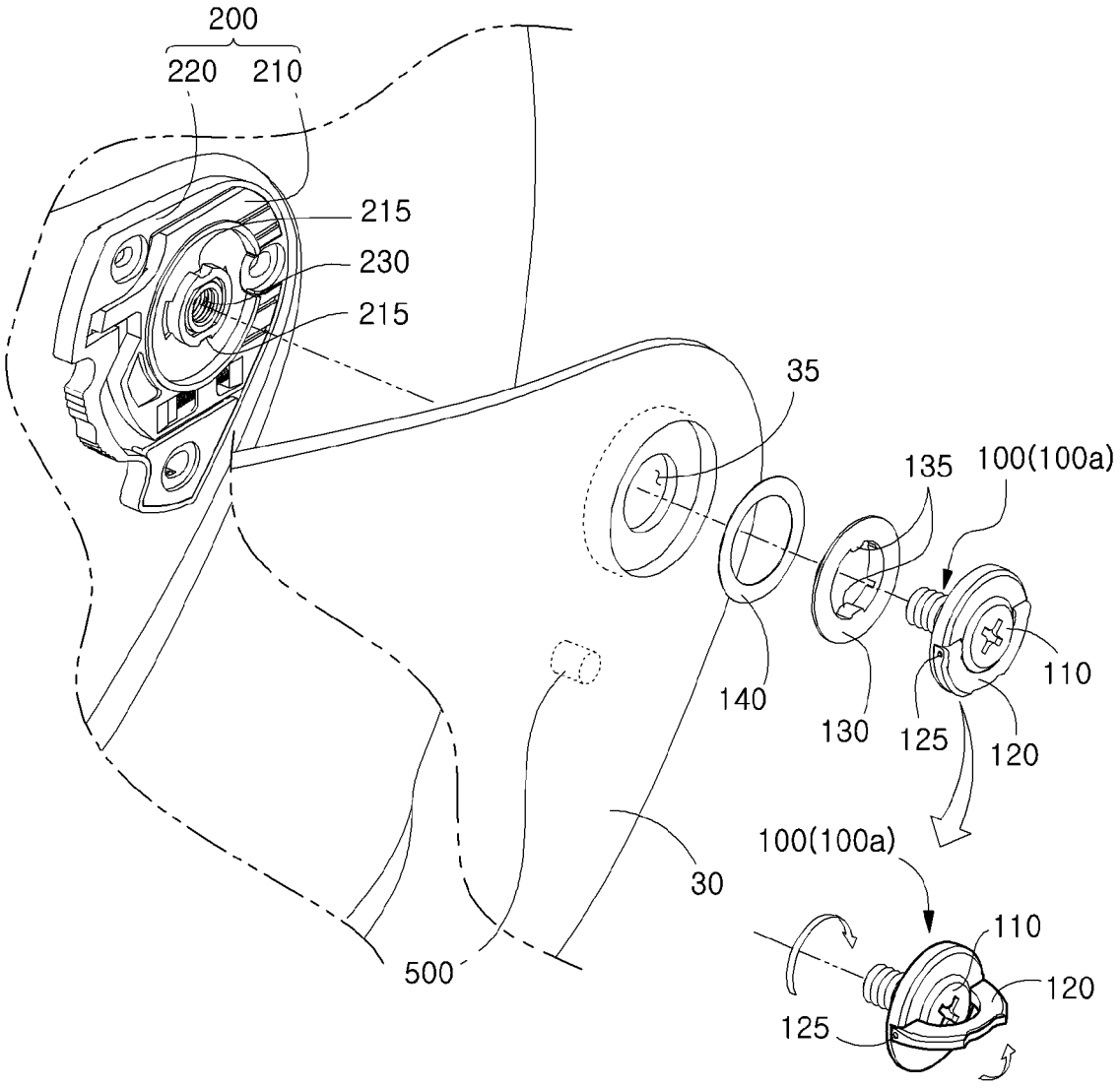
FIG. 8 is an exploded perspective view of a rotating means for a helmet according to an embodiment of the present disclosure.

FIG. 8 is an exploded perspective view of the rotating means for the helmet according to an embodiment of the present disclosure.

As shown in FIG. 8, the rotation axis 100 is not limited to particular type, but may be a bolt 100*a* that is inserted into the shield 30 and the movement means 200 (the moving body 210). Specifically, the shield 30 may have a first through-hole 35, and the movement means 200 (the moving body 210) may have a second through-hole 230. In this instance, after the first through-hole 35 of the shield 30 and the second through-hole 230 of the movement means 200 (the moving body 210) are aligned with each other, when the bolt 100*a* is inserted into the first and second through-holes 35, 230, the shield 30 may be rotatably coupled to the movement means 200 (the moving body 210). More specifically, the bolt 100*a* may be screw-coupled to the second through-hole 230 of the movement means 200 (the moving body 210), and a first washer 130 may be disposed between a head 110 of the bolt 100*a* and the shield 30. Here, a coupling protrusion 135 that protrudes inward may be formed in the inner circumferential surface of the first washer 130, and a recessed coupling groove 215 may be formed in the outer wall of the second through-hole 230 of the movement means 200 (the moving body 210) that protrudes toward the shield 30. In this instance, the coupling protrusion 135 of the first washer 130 may be inserted into the coupling groove 215 of the movement means 200 (the moving body 210), and accordingly, even though the shield 30 rotates, the first washer 130 does not rotate. As described above, since the first washer 130 does not rotate, it may be possible to prevent the bolt 100*a* from loosening when the shield 30 rotates. However, the present disclosure is not necessarily limited to the first washer 130 having the coupling protrusion 135 and the movement means 200 (the moving body 210) having the coupling groove 215, and the movement means 200 (the moving body 210) may have the coupling protrusion 135 and the first washer 130 may have the coupling groove 215.

As described above, even though the shield 30 rotates, the first washer 130 does not rotate, and thus the user may have difficulty in rotating the shield 30 due to the friction between the shield 30 and the first washer 130. Accordingly, a second washer 140 may be disposed between the shield 30 and the first washer 130 to reduce the friction. In this instance, the second washer 140 may be a lubricating member. For example, the lubricating member may be a lubricant tape.

In addition, the bolt 100*a* may include a manipulation portion 120. The manipulation portion 120 is formed in a U shape around a side of the head 110 of the bolt 100*a*, and is disposed to rotate with respect to the head 110 of the bolt 100*a* around a pivot axis 125 perpendicular to a lengthwise direction of the bolt 100*a*. The user may rotate the manipulation portion 120 perpendicularly to the head 110 of the bolt 100*a*, and hold the manipulation portion 120 and then rotate the bolt 100*a*. Accordingly, the user may couple the shield 30 to the movement means 200 (the moving body 210) or separate the shield 30 from the movement means 200 (the moving body 210) by rotating the bolt 100*a* using the manipulation portion 120 without any tool such as a driver.

While the present disclosure has been hereinabove described in detail through the specific embodiments, this is provided to describe the present disclosure in detail, and the present disclosure is not limited thereto, and it is obvious that modifications or changes may be made thereto by those having ordinary skill in the art within the technical spirit of the present disclosure.

Such modifications and changes of the present disclosure fall in the scope of the present disclosure, and the scope of protection of the present disclosure will be apparent by the appended claims.

[Detailed Description of Main Elements]

| | |
|---|---|
| 10: Helmet body | 20: Open portion |
| 25: Gasket | 30: Shield |
| 35: First through-hole | 100: Rotation axis |
| 100a: Bolt | 110: Head |
| 120: Manipulation portion | 125: Pivot axis |
| 130: First washer | 135: Coupling protrusion |
| 140: Second washer | 200: Movement means |
| 210: Moving body | 213: Slide protrusion |
| 215: Coupling groove | 220: Support body |
| 223: Predefined space | 225: Slide groove |
| 230: Second through-hole | 300: Elastic means |
| 400: First guide | 400a: Contact surface |
| 410: First recessed portion | 420: Second recessed portion |
| 430: Protruding portion | 420: Auxiliary recessed portion |
| 500: Second guide | |

INDUSTRIAL APPLICABILITY

The present disclosure provides the rotating means for the helmet in which the shield is disposed at the relatively front side of the helmet body immediately until it closes the open portion, and when the shield rotates in the direction of closing the open portion, the rotation axis of the shield moves rearward with respect to the helmet body, thereby forming a tight seal between the shield and the edge of the open portion.

The invention claimed is:

1. A rotating means for a helmet, comprising:

a rotation axis which rotatably couples a shield to a helmet body to allow the shield to open and close an open portion of the helmet body, wherein the rotation axis moves rearward with respect to the helmet body in response to rotation of the shield in a direction of closing the open portion, and a movement means to couple the rotation axis to the helmet body to allow the rotation axis to move forward and rearward with respect to the helmet body, the movement means including:

a moving body at which the rotation axis is disposed, and a support body coupled to the helmet body to support the moving body to move forward and rearward with respect to the helmet body, wherein any one of the moving body and the support body has a slide protrusion which protrudes toward the other, and wherein the other one of the moving body and the support body has a slide groove extended to allow the slide protrusion inserted therein to slide.

2. The rotating means for the helmet according to claim 1, further comprising:

an elastic means configured to provide the movement means with an elastic force to a rear side of the helmet body.

3. The rotating means for the helmet according to claim 2, wherein the movement means includes a first guide to guide the rotation of the shield and the movement of the rotation axis, and wherein the shield includes a second guide that comes into contact with the first guide by the elastic force of the elastic means.

4. The rotating means for the helmet according to claim 3, wherein the first guide includes a contact surface extended in an arc shape, and wherein the second guide moves in contact with the contact surface.

5. The rotating means for the helmet according to claim 4, wherein a first recessed portion is formed at one end of the contact surface, a second recessed portion is formed at the other end of the contact surface, and a protruding portion is formed between the first recessed portion and the second recessed portion on the contact surface, and wherein the rotation axis moves rearward with respect to the helmet body in response to the contact of the second guide with the first recessed portion and the second recessed portion, and wherein the rotation axis moves forward with respect to the helmet body in response to the contact of the second guide with the protruding portion.

6. The rotating means for the helmet according to claim 5, wherein the second guide is secured by the elastic force of the elastic means in response to the contact of the second guide with the first recessed portion and the second recessed portion.

7. The rotating means for the helmet according to claim 5, wherein an auxiliary recessed portion is formed in the middle of the protruding portion on the contact surface, and wherein the rotation axis moves rearward with respect to the helmet body in response to the contact of the second guide with the auxiliary recessed portion.

8. The rotating means for the helmet according to claim 7, wherein the second guide is secured by the elastic force of the elastic means in response to the contact of the second guide with the auxiliary recessed portion.

9. The rotating means for the helmet according to claim 1, wherein the rotation axis moves forward with respect to the helmet body in response to the rotation of the shield in a direction of opening the open portion.

10. The rotating means for the helmet according to claim 1, wherein the rotation axis moves rearward with respect to the helmet body in response to the rotation of the shield at a first predetermined angle in a direction of opening the closed open portion, and wherein the rotation axis moves rearward with respect to the helmet body in response to the rotation of the shield at a second predetermined angle smaller than the first predetermined angle in the direction of opening the closed open portion.

11. The rotating means for the helmet according to claim 1, further comprising:

an elastic means disposed between the moving body and the support body to provide the moving body with an elastic force in a rearward direction of the helmet body.

12. The rotating means for the helmet according to claim 1, wherein the rotation axis is a bolt which is inserted into the shield and the movement means.

13. The rotating means for the helmet according to claim 12, wherein the bolt includes a manipulation portion formed around a head of the bolt and disposed to rotate with respect to the head around a pivot axis perpendicular to a lengthwise direction of the bolt.

14. The rotating means for the helmet according to claim 12, wherein the bolt is coupled to the movement means, wherein a first washer is disposed between a head of the bolt and the shield, wherein any one of the first washer and the movement means has a coupling protrusion, and wherein the other one of the first washer and the movement means has a coupling groove into which the coupling protrusion is inserted.

15. The rotating means for the helmet according to claim 14, wherein a second washer is disposed between the shield and the first washer, and wherein the second washer is a lubricating member.

* * * * *